US006799513B2

(12) United States Patent
Schäfer

(10) Patent No.: US 6,799,513 B2
(45) Date of Patent: Oct. 5, 2004

(54) METHOD AND DEVICE FOR SUPPLYING HYDRAULIC FLUID

(75) Inventor: Karl Robert Schäfer, Rimpar (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/239,191

(22) PCT Filed: Feb. 1, 2001

(86) PCT No.: PCT/DE01/00384

§ 371 (c)(1),
(2), (4) Date: Sep. 27, 2002

(87) PCT Pub. No.: WO01/73334

PCT Pub. Date: Oct. 4, 2001

(65) Prior Publication Data

US 2003/0051620 A1 Mar. 20, 2003

(30) Foreign Application Priority Data

Mar. 27, 2000 (DE) ..... 100 15 165

(51) Int. Cl.[7] ..... B41F 27/12
(52) U.S. Cl. ..... 101/415.1; 137/225
(58) Field of Search ..... 101/415.1, 378; 279/4.01; 137/225, 226, 231, 798

(56) References Cited

U.S. PATENT DOCUMENTS 4,938,134 A * 7/1990 Dorsam et al. ..... 101/415.1
5,255,604 A * 10/1993 Dürr ..... 101/389.1
5,396,843 A * 3/1995 Durr ..... 101/415.1
5,503,072 A * 4/1996 Schneider ..... 101/415.1
5,732,629 A * 3/1998 Puschnerat et al. ..... 101/415.1
5,738,012 A * 4/1998 Metrope ..... 101/415.1
5,921,183 A * 7/1999 Jones ..... 101/483

FOREIGN PATENT DOCUMENTS

EP 3309815 C2 * 4/1987
EP 0 307 890 B1 * 3/1989
EP 0 554 815 A1 * 8/1993
EP 0 606 604 A1 * 7/1994
EP 0 638 420 A1 * 2/1995
EP 0 606 604 B1 * 7/1997
EP 0 740 609 B1 * 8/1997
EP 0 713 770 B1 * 5/1998
EP 0 858 890 A1 * 8/1998

* cited by examiner

*Primary Examiner*—Leslie J. Evanisko
(74) *Attorney, Agent, or Firm*—Jones, Tullar & Cooper PC

(57) ABSTRACT

Deformable hollow bodies are placed in cylinders of printing presses to actuate retaining and clamping devices. The hollow bodies require a sealed supply channel for supply of a pressure medium. A sealing surface and a dividing surface between the cylinder and the hollow body are arranged parallel to each other and generally perpendicularly to the direction of pressure generated by the pressure medium flowing into the hollow body.

30 Claims, 1 Drawing Sheet

METHOD AND DEVICE FOR SUPPLYING HYDRAULIC FLUID

FIELD OF THE INVENTION

The present invention is directed to a method and to a device for supplying a pressure medium to a deformable hollow body. The hollow body is provided with an opening that receives a supply of the pressure medium.

BACKGROUND OF THE INVENTION

An arrangement of a hose, which can be used for operating a device for clamping flexible printing plates on a forme cylinder and which can be charged with a pressure medium, is known from EP 0 606 604 B1. The hose is arranged on a fastening strip, fixed in place on the cylinder, in the axial extension approximately in the middle between two axial, prestressed clamping strips that are extending in an axis-parallel groove.

The supply of pressure medium to the hose is accomplished through a connecting tube. The connecting tube extends through the fastening strip and is frictionally connected with a sleeve on the underside of the fastening strip facing away from the hose. The sleeve is sealed with the aid of sealing rings and is connected with a flange arranged on the underside of the fastening strip. The sealing faces between the connecting tube and the sleeve, or between the sleeve and the flange, extend parallel in respect to the pressure and force direction.

The connecting tube, which is embodied as a threaded pin with a bore, projects, on the side facing the hose, through a hole in the casing of the hose into its interior. The connecting tube can be fastened releasably and interlockingly in the interior of the hose by the use of a nut.

When mounting the hose, the hole in the hose casing must be pushed on the connecting tube fixed on the cylinder and, if required, must be fastened on the inside of the hose with a nut. In the arrangement depicted in EP 0 606 604 B1, the mounting of the hose must be performed in the radial direction from the shell surface of the cylinder.

When a pressure medium is supplied to the hose through the connecting tube, the hose inflates or expands and pushes the two clamping strips apart in the circumferential direction of the forme cylinder.

EP 0 307 890 B1 shows a device for clamping and tensioning printing plates on a plate cylinder, by using hoses which can be charged with a pressure medium. For tensioning the printing plate, the entire tensioning and clamping device, which is movably arranged in the cylinder groove, is displaced approximately in the circumferential direction of the plate cylinder. This movement takes place against the force of a restoring spring by use of a hose, which can be charged with a pressure medium and which is supported on the groove wall fixed in the cylinder. The clamping device is operated by a toggle lever, which is maintained in the clamping position by a spring force. A hose is used for opening the clamping device which hose, when charged with a pressure medium, forces the toggle lever out of the extended position against the spring force. The mechanism used for the introduction of a pressure medium into the hose is not explained in this prior art document.

DE 33 09 815 C2 discloses a clamping device for a cylinder shell, wherein a clamping sleeve, together with the shell surface of a journal and O-rings arranged between the journal and the clamping sleeve, form a deformable annular chamber. The supply of a pressure medium takes place through a radial bore through the journal, with an orifice in the annular chamber. When charged with a pressure medium, the clamping sleeve is deformed in the radial direction of the journal and holds a front disk of a cylinder shell.

Additional examples of mechanisms and of devices for holding or clamping of plates or covers on cylinders, and which are operated by pressure media, are provided in the publications EP 0 606 604 A 1, EP 0638 420 A1, EP 0 713 770 B1, EP 0 740 609 B1 or EP 0 858 890 A1, and depict a lever mechanism, the drive mechanism for a toothed rack or leaf spring, a displaceable clamping jaw or the plate or covering for the cylinder itself, which is to be held. The above examples all require an assembly at the end, or laterally inside the channel, of the hose which can be charged with pressure medium in the cylinder.

A solution for supplying a medium charged with pressure to a rotatable body itself is proposed in the publication EP 0 554 815 A1, for example.

SUMMARY OF THE INVENTION

The object of the present invention is directed to providing a method and a device for supplying a pressure medium to a deformable hollow body.

In accordance with the present invention, this object is attained by providing the deformable hollow body with a pressure medium receiving opening. The hollow body is arranged on a support surface with its opening aligned with a mouth of a pressure medium supply line. Charging of the hollow body with a pressure medium seals the opening in the hollow body to the supply line and to the support surface. The supply line does not penetrate the hollow body.

The advantages to be realized by the present invention reside, in particular, in that only slight demands are to be made on the accessibility of the supply device for the pressure medium and the position of the hose, since there is no rigid passage, fixed in the cylinder, and extending through the hose wall. The device in accordance with the present invention permits the arrangement of, and exchange of hoses to be supplied with pressure media, at places inside the cylinder, or inside the clamping device, which are difficult to reach. The supply device permits the employment of various types of hoses to be charged with pressure medium for operating holding or clamping devices. For example, the pressure medium hose can be inserted inside the channel into the clamping device in the circumferential direction laterally or at the front or end of the channel.

It is also an advantage of the device of the present invention that, in case of a relative movement between the hose and the line for supplying the pressure medium, no damages occur. This is because the parts of the supply line to be assigned to the cylinder and to the hose do not penetrate each other.

A further advantage of the device of the present invention for supplying pressure medium is the simple and rapid pre-assembly, as well as the insertion into the clamping device, without a requirement for a tool or aids which the invention provides.

The self-sealing property of the device of the present invention, because of the arrangement of the sealing faces perpendicularly to the pressure and force direction acting in the operating state, is particularly advantageous.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

A device, not described in detail, and which is useable for the frictional or for the interconnected holding and/or clamping of at least one cover or dressing, for example a printing plate, on a forme cylinder, or a rubber blanket on a transfer cylinder, is arranged in a cylindrical body, such as, for example, a forme or transfer cylinder of a printing press, in an axially extending channel of a cylinder shell.

The actuation of that device, for clamping or holding the cover or dressing, takes place through the use of a deformable hollow body such as, for example, a hose 01, which hose 01 is present in the channel of the cylinder and which hose 01 can be charged with a fluid which acts as the pressure medium to expand the hose. That pressure medium can be, for example, compressed air.

Figure 1:
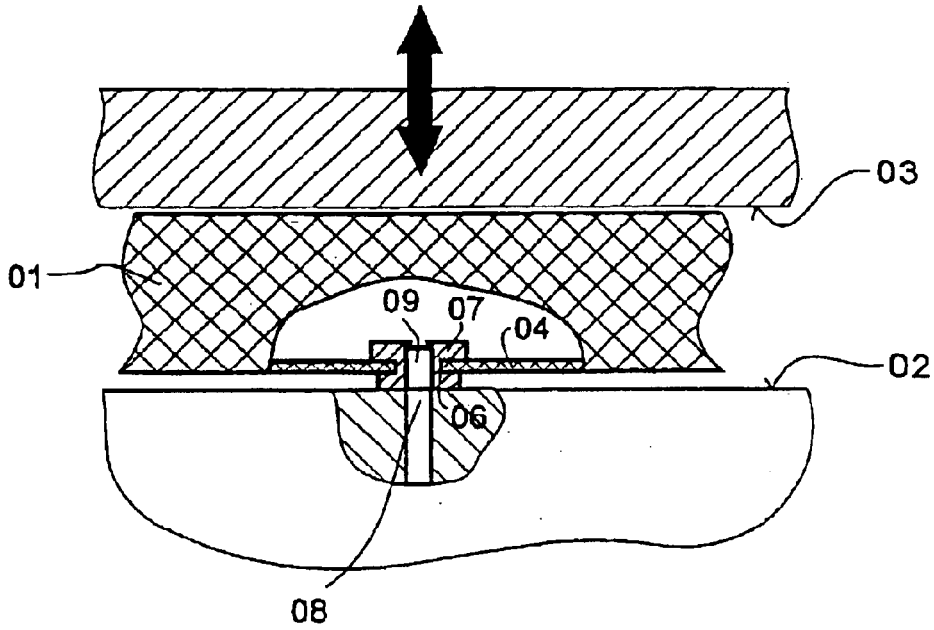
FIG. 1, a schematic side elevation view, partly in section of a portion of a hose, which hose can be charged with a pressure medium, and a supply device in accordance with the present invention, and in FIG. 2, an enlarged representation of the passage of FIG. 1.

As may be seen by initially referring to FIG. 1, the hose 01 is arranged between a surface 02, for example the support surface 02, which support surface 02 is assigned to the cylinder, and a surface 03, which is assigned to the device for clamping or holding to be operated by the hose 01. For example, the support surface 02 is embodied as a lateral wall of the channel, fixed in the cylinder. In another embodiment, it can also be a surface of the movable device for holding or clamping.

On its side facing the support surface 02, a wall 04 of the hose 01 has an opening 09, through which the pressure medium is fed into the hose 01. The hose opening 09 is aligned with, and cooperates with a mouth 08 of a line, which line mouth 08 is arranged in the side of the support surface 02 and facing the hose 01.

The opening 09 in the hose 01 can be a cutout 06 formed directly in the wall 04 of hose 01. However, opening 09 can also be a bore 09 in a fitting 07 which is arranged in the cutout 06 of the wall 04.

Figure 2:
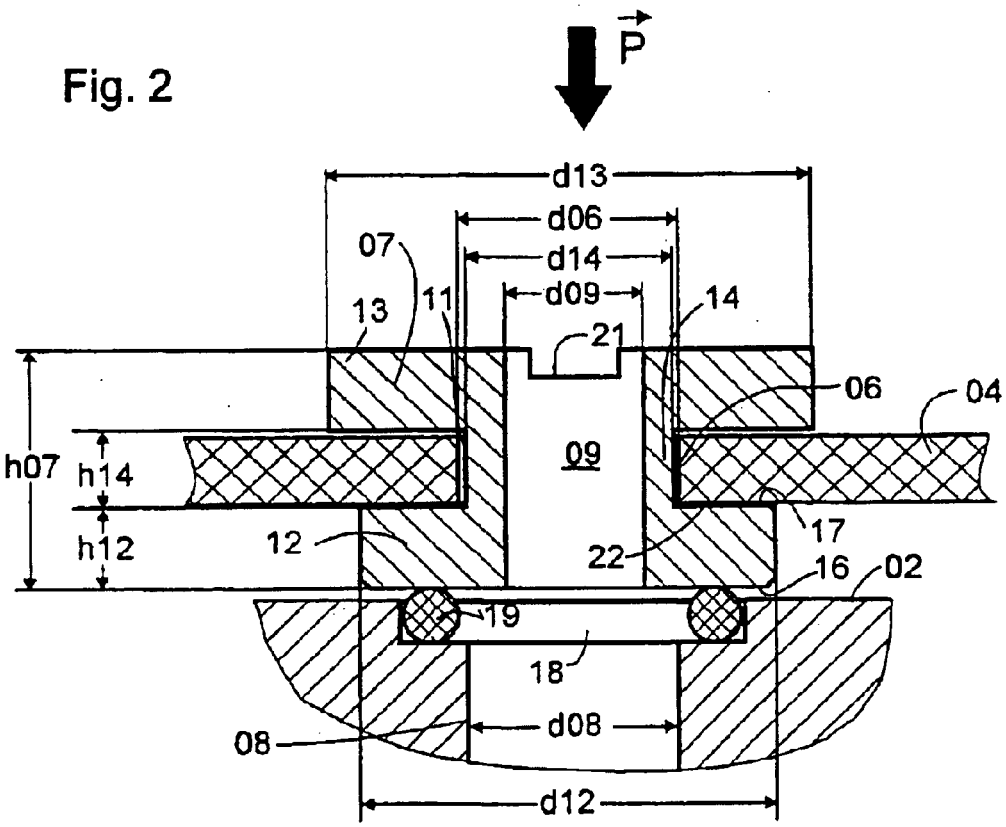

In the preferred embodiment depicted in FIGS. 1 and 2, the opening 09 in the hose 01 is embodied as an axial bore formed in a disk 07 that is arranged in the cutout 06 of the hose 01. The disk 07 is provided with a circumferential groove 11 in its exterior shell surface. The external circumferential groove 11 divides the disk 07 into a first or outer flange 12 facing the support surface 02, a second flange 13 located in the interior of the hose 01, and a constriction 14 located between them. On the outer end face of the first or outer flange 12 there is a surface 16 which, in cooperation with the support surface 02, acts as a sealing face. On its side facing the hose 01 the outer flange 12 has an inner face formed by a surface 17. This outer flange inner face 17 acts as a sealing face with the outer surface of the wall 04 of the hose 01.

In an advantageous configuration of the disk 07, the structure of the outer flange end face sealing surface 16 should not exceed a surface roughness of 16 $\mu$m, preferably 4 $\mu$m. The outer flange inner face surface 17 does not require such high demands on the surface structure, so that a surface roughness of 16 $\mu$m is sufficient.

An interior diameter d09 of the bore 09 of the disk 07 is sized based on the required pressure medium flow and in the present embodiment d09=3 mm. The exterior diameter d14 of the constriction 14, for example, is d14=6 mm. The exterior diameter d12, for example d12=8.5 mm, of the outer flange 12 is a function of the demands made on the seal of the outer flange outer end face sealing surface 16 of the disk 07 toward the support surface 02, and the outer flange inner face surface 17 of the disk 07 toward the wall 04 of the hose 01. The second or inner flange 13 is used for holding the disk 07 in the wall 04 of the hose 01, and in the preferred embodiment has an exterior diameter of d13=10 mm. The disk 07 has a height "h" of, for example, h07=3.5 mm. In the preferred embodiment, the outer flange 12 is embodied with a height h12=1 mm, and the constriction with a height h14=1.5 mm, which construction height h14 depends on the thickness of the wall 04 of the hose 01. In the preferred embodiment, the disk 07 has a radially extending groove 21 on the outer end face of the inner flange 13. This groove 21 makes possible the supply of, or the escape, of the pressure medium through the bore 09 in case the wall 04 of the hose 01, which is located directly opposite the inner flange 13, rests directly on the inner flange 13.

In place of the disk 07 described in the preferred embodiment, other constricted forms can be selected as the passage 07, which have a structure, embodied as flange 12 in the preferred embodiment, cooperating with the support surface 02, with a flat surface 16; a flat surface 17 cooperating with the wall 04 of hose 01, if required; a detent, such as the inner flange 13 in the preferred embodiment, and arranged in the interior of the hose 01: a taper, which is as constriction 14 in the preferred embodiment, and which projects at least partially into the wall 04; and a penetrating opening extending in the longitudinal direction, in the preferred embodiment, a bore 09. The taper 14 can also be embodied as a tube which, when there is a detent 13, connects the latter with the disk 12.

On the side of the hose 01 facing the support surface 02, the cutout 06, in which the disk 07 is arranged, is located in the wall 04 of hose 01. Advantageously the diameter d06 of the cutout 06, for example d06=5 mm has been selected, depending on the elastic properties of the hose material, to be less than the exterior diameter d14 of the constriction 14, so that an interconnected and frictionally tight connection between the disk 07 and the hose 01 is created. Several spaced disks 07 and associated mouths of lines 08 for hose 01 can be provided in the support surface 02. For reasons of ease of assembly; the disk 07 and the associated mouth of the line 08 are preferably arranged in the area of the ends of the hose 01. The disk 07 is positioned on the hose 01 in such a way that, with the hose 01 inserted into the channel of the cylinder, the longitudinal axis of the bore 09 of the disk 07, and the longitudinal axis of the mouth of the line 08 cooperating with the disk 07 are fully aligned, in the ideal case. To be operational, the bore 09 and the mouth of the line 08 must at least intersect.

The hose 01, equipped with a disk 07, is arranged in the channel, and is fixed in relation to the support surface 02, in such a way that the outer flange outer end face sealing surface 16 facing the support surface 02 rests on the support surface 02, even in the relaxed state of the hose 01 when hose 01 is not charged with a pressure medium.

The interior diameter d08 of the mouth of the line 08 can be equal to the interior diameter d09 of the opening 09, or bore 09. To facilitate an assured intersection of the mouth of the line 08 and the opening 09, the interior diameter d08 of the mouth of the line 08, for example d08=5 mm, can be selected to be greater than the diameter d09 of the opening 09 in the disk 07. This assures the certain coverage of the mouth of the line 08 by the flange 16, even in the flaccid state where the hose 01 is not charged with a pressure medium, as well as in the case of manufacturing or assembly tolerances in the arrangement of the hose 01, or of the disk 07, or of the mouth of the line 08.

A further increase of the interior diameter d08 also requires an increase of the diameter of the cooperating outer flange 12. When using a disk or other fitting 07, the exterior diameter d12 of the outer flange, the interior diameter d09 of the bore 09 and the interior diameter d08 of the mouth of the line 08 should be selected in an advantageous manner in such a way, that the relationship:

$$\frac{(d12-d09)}{2} < d08 < \frac{(d12+d09)}{2}$$

is met.

In further preferred embodiment of the present invention, which is not specifically represented, the diameter of the bore 09 of the disk 07 can also be selected to be larger than the interior diameter d08 of the mouth of the line 08.

In an advantageous manner, similar demands should also be made on the surface structure of the support surface 2, at least in the area of the mouth of the line 08, that are made on the surface 16, namely a surface roughness of less than or equal to 16 $\mu$m. Alternatively to this, it is possible to arrange a sealing element 19, such as for example a rubber or metal seal ring 19, in a groove 18 surrounding the mouth of the line 08 in the support surface 02. The sealing element 19 arranged in the support surface 02, and the surface 16 of the outer flange 12 of the disk 07 facing it, in this case act together as sealing faces.

If, in an embodiment variation of the device of the present invention, the use of a disk 07, or a fixture 07 of a different type, is omitted, the cutout 06 of the hose 01 constitutes the opening 09 for supplying the pressure medium to the hose 01. In this case, the support surface 02, or the sealing element 19 arranged in it, and an outer surface 22 of the wall 04 facing the support surface 02, act together as a sealing face.

When the hose or hollow body 01 is charged with a pressure medium, the same pressure acts inside the hollow body 01 on all surfaces of body 01 in the normal direction. Here, the direction of the pressure P is understood to be the direction which is oriented approximately parallel with the longitudinal axis of the opening 09. The above-described embodiments have in common the arrangement of sealing faces, which are essentially perpendicular, in respect to the direction of the pressure P, between the two units, which sealing faces are configured so they can be separated from each other, and therefore provide the self-sealing property of the device for supplying the pressure medium. When charged with pressure, the sealing faces are pressed against each other, so that in the operational state, the act of the charging of the hose 01 with pressure medium itself provides the seal of the supply device.

The support surface 02 to be assigned to the cylinder, and with the mouth of the line 08, constitutes a first unit. The hollow body 01 with the opening 09 and with the surface 16, or 22, constitutes a second unit, acting together with the first unit, which first and second units are structured to be separable from each other. The seal of the supply device for the pressure medium between these two units, which can be separated from each other, takes place via the surfaces 16 or 22, together with the support surface 02, or the sealing element 19. The separating and sealing faces are located on planes which, when the hollow body 01 is charged with pressure medium, extend almost perpendicularly in respect to the direction of the pressure P. Since the two units do not penetrate each other, in the state when pressure is applied, the connection between the two units takes place only in a frictionally connected manner, in all spatial directions. The hollow body 01 with the opening 09, if required with the fixture 07 having the opening 09, can, in this way, be inserted, or removed, in a simple manner, and can be separated from the support surface 02 to be assigned to the cylinder. A separation takes place in an advantageous manner almost perpendicularly in respect to the mouth of the line 08, or of the opening 09.

The mounting and mode of functioning of the device for supplying a pressure medium in accordance with the present invention are as described in what follows:

A cutout 06 is arranged in the hose 01 at the location in the hose 01 defined by the position of the mouth of the line 08 and the hose 01. The disk 07 having the opening 09 is pushed, for example from the inside of the hose 01, through the cutout 06. The device for supplying the pressure medium, consisting of the hose 01 and the disk 07, is inserted into an appropriate holder, not described in great detail here, in the channel of the cylinder. After the device for supplying the pressure medium has been inserted with the correct fit in respect to the position of the mouth of the line 08, i.e. so that the mouth of the line 08 and the opening 09 in the fixture 07 at least partially intersect, the pressure supply device is ready to operate. Thereafter, the charging of the hollow body 01 with pressure medium takes place, and with this, the simultaneous sealing between the surfaces 02, 16, or 22, which are arranged to lie flat on each other and do not penetrate each other, namely the support face 02 and the surface 16, or 22, of the passage 07, or of the hollow body 01.

Upon actuating a device, which is not specifically represented here, for providing pressure medium, that pressure medium, which may be, for example, compressed air, flows through the mouth of the line 08 and the bore 09 of the disk 07 into the hose 01. The previously flaccid hose 01 is filled and takes up more space. It is supported on the support surface 02 and contacts the surface 03 of the device for clamping or releasing, holding or letting go, of dressings or coverings on cylinders. Because of the resistance of the clamping or holding device which can result from the dressing or covering to be clamped itself, from a spatial limitation, or from the restoring force of the device, the wall 04 of the hose 01, and therefore also the outer flange 12, are pressed against the support surface 02, and the outer flange outer end face sealing surface 16 is frictionally and self-sealingly connected with the support surface 02. In the same way, the outer surface 22 of the wall 04 of the hose 01 is self-sealingly connected with the outer flange inner face surface 17 of the outer flange 12.

In connection with an embodiment of the supplying device, but with the use of a fixture 07, the surface 22 of the wall 04 of hose 01 is directly connected with the support surface 02 in a self-cleaning and frictionally connected manner.

While a preferred embodiment of a device for supplying a pressure medium in accordance with the present invention has been set forth fully and completely hereinabove, it will be apparent to one of skill in the art that various changes in, for example the source of supply of the pressure medium, the overall size of the hose and cylinder and the like could be made without departing from the true spirit and scope of the present invention which is accordingly to be limited only by the following claims.

What is claimed is:

1. A method for supplying pressure medium to a reversibly deformable hollow body including:

providing an opening in a surface of a wall of said hollow body;

arranging said hollow body on a support surface;

providing a mouth of a pressure medium supply line on said support surface;

aligning said opening and said mouth;

supplying a pressure medium to said supply line;

charging said hollow body with said pressure medium; and deforming said hollow body for sealing said mouth of said support surface and said opening of said wall surface which lie flat on each other and do not penetrate each other.

2. The method of claim 1 further including providing a fitting and placing said fitting in said wall, said fitting including said opening, said sealing taking place between said mouth of said support surface and said fitting.

3. A device for supplying a pressure medium to a reversibly deformable hollow body comprising:

a wall of said hollow body, said wall having a wall surface;

a pressure medium receiving opening in said wall surface;

a support surface adapted to support said hollow body;

a pressure medium supply line in said support surface, said pressure medium supply line having a mouth on said support surface, said mouth and said opening intersecting, said wall surface and said support surface acting together as sealing faces and being separable from each other and further being parallel to each other and perpendicular to a direction of pressure generated in said hollow body during supply of a pressure medium to said hollow body.

4. The device of claim 3 wherein said pressure medium receiving opening in said wall surface of said reversibly deformable hollow body is a cutout in said wall of said hollow body.

5. The device of claim 3 wherein said pressure medium receiving opening in said wall surface of said hollow body includes a fitting, said fitting having an outer flange, said outer flange having an inner surface engaging said wall surface and which extends parallel with said wall surface, and a flat outer surface facing away from said hollow body.

6. The device of claim 5 wherein said flat outer surface extends generally perpendicular to said direction of pressure.

7. The device of claim 5 wherein said inner surface and said wall surface act together as sealing faces and are generally perpendicular to said direction of pressure.

8. The device of claim 5 wherein said fitting includes a disk and a taper, said taper projecting at least partially into said wall of said hollow body.

9. The device of claim 8 wherein said disk includes said outer flange.

10. The device of claim 8 wherein said disk has an exterior diameter (d12), wherein said opening has an interior diameter (d09), and said mouth has an interior diameter (d08) and wherein the relationship $$\frac{(d12 - d09)}{2} < d08 < \frac{(d12 + d09)}{2}$$

is met.

11. The device of claim 8 further including a face on said taper and a detent on said face, said detent being opposite to said disk.

12. The device of claim 11 further including a front end on said detent, said front end having a groove, said groove facing into an interior portion of said hollow body.

13. The device of claim 3 wherein said mouth and said opening do not penetrate each other.

14. The device of claim 3 wherein said opening has a surface and further wherein said surface and said support surface are frictionally and self-sealingly connected.

15. The device of claim 3 further including a sealing element on one of said support surface and said wall surface.

16. The device of claim 3 wherein said hollow body is configured to be positioned in a device adapted for clamping a covering on a cylinder of a printing press, said hollow body being useable to operate said covering clamping device.

17. The device of claim 3 wherein said hollow body is configured to be positioned in a device adapted for clamping at least one printing plate on a forme cylinder of a printing press, said hollow body being useable to operate said plate clamping device.

18. A device for supplying a pressure medium to a reversibly deformable hollow body comprising:

a wall of said hollow body, said wall having an outer wall surface;

an opening in said wall;

a fitting in said opening;

a pressure fluid receiving passage in said fitting;

an outer flange on said fitting, said outer flange having an inner surface adjacent to and parallel to said outer wall surface of said wall of said hollow body, said outer flange further having an outer flat surface, said outer flat surface facing away from said hollow body;

a support surface adapted to support said hollow body; and a pressure medium supply line in said support surface, said pressure medium supply line having a mouth on said support surface, said mouth being arranged opposite to said fitting.

19. The device of claim 18 wherein said passage extends in a longitudinal direction of said fitting.

20. The device of claim 18 wherein said hollow body and said support surface are separable and further wherein said outer flat surface and said support surface act as sealing faces, are separable from each other, and lie in a plane generally perpendicular to a pressure force generated by a pressure medium supplied to said hollow body.

21. The device of claim 18 wherein said mouth and said passage at least partially intersect.

22. The device of claim 21 wherein said mouth and said opening do not penetrate each other.

23. The device of clam 21 wherein said passage has a surface and further wherein said surface and said support surface are frictionally and self-sealingly connected.

24. The device of claim 18 wherein said outer flat surface is generally perpendicular to a direction of pressure generated in said hollow body during supply of a pressure medium to said hollow body.

25. The device of claim 18 wherein said inner surface and said outer wall surface act together as sealing faces and are generally perpendicular to a direction of pressure generated in said hollow body during supply of a pressure medium to said hollow body.

26. The device of claim 18 wherein said fitting includes a disk and a taper, said taper projecting at least partially into said wall of said hollow body.

27. The device of claim 26 wherein said disk includes said outer flange.

28. The device of claim 18 further including a sealing element on one of said support surface and said wall surface.

29. The device of claim 18 wherein said hollow body is configured to be positioned in a device adapted for clamping a covering on a cylinder of a printing press, said hollow body being useable to operate said covering clamping device.

30. The device of claim 18 wherein said hollow body is configured to be positioned in a device adapted for clamping at least one printing plate on a forme cylinder of a printing press, said hollow body being useable to operate said plate clamping device.

* * * * *